US006141931A

United States Patent [19]

Simmons

[11] Patent Number: 6,141,931

[45] Date of Patent: Nov. 7, 2000

[54] FLOOR TRANSITION PIECE AND METHOD OF INSTALLING SAME

[76] Inventor: Kenneth R. Simmons, 1005 SW. Crossing Dr., Lee's Summit, Mo. 64081

[21] Appl. No.: 08/971,816

[22] Filed: Nov. 17, 1997

[51] Int. Cl.[7] ..... E04B 1/68

[52] U.S. Cl. ..... 52/480; 52/403.1; 52/391; 52/396.04; 52/746.1; 16/16

[58] Field of Search ..... 52/480, 403.1, 52/391, 393, 471, 396.04, 718.04, 717.06, 746.1, 747.11; 16/4, 6, 7, 16; 49/468, 469

[56] References Cited

U.S. PATENT DOCUMENTS

| | | | |
|---|---|---|---|
| 336,951 | 3/1886 | Sanderson . | |
| 1,207,827 | 12/1916 | Winters . | |
| 1,603,366 | 10/1926 | Upson . | |
| 1,769,283 | 7/1930 | Awbrey | 16/16 |
| 2,657,948 | 11/1953 | Sturtevant . | |
| 2,882,560 | 4/1959 | Plendl | 52/391 X |
| 2,892,208 | 6/1959 | Stock . | |
| 3,086,262 | 4/1963 | Krantz | 16/16 |
| 3,222,837 | 12/1965 | Daley . | |
| 3,309,832 | 3/1967 | Filsinger . | |
| 3,408,250 | 10/1968 | Finefrock | 52/396.04 X |
| 4,289,818 | 9/1981 | Casamayor . | |
| 5,390,458 | 2/1995 | Menchetti | 52/417 |
| 5,465,546 | 11/1995 | Buse . | |
| 5,475,953 | 12/1995 | Greenfield . | |
| 5,477,650 | 12/1995 | Centa . | |
| 5,517,788 | 5/1996 | McGought et al. | 49/468 |
| 5,581,967 | 12/1996 | Glatz | 52/396.04 X |
| 5,671,575 | 9/1997 | Wu | 52/403.1 |

FOREIGN PATENT DOCUMENTS

| | | | |
|---|---|---|---|
| 2694 | 7/1926 | Australia | 16/16 |
| WO 92/02163 | 2/1992 | WIPO | 16/7 |

*Primary Examiner*—Carl D. Friedman
*Assistant Examiner*—Winnie S. Yip
*Attorney, Agent, or Firm*—Sonnenschein Nath & Rosenthal; Jennifer H. Hammond

[57] ABSTRACT

A floor transition piece is provided for spanning between first and second floorings having vertically offset top surfaces, such as a wood flooring and a vinyl flooring. The transition piece comprises an elongated body having a transition surface for extending between the vertically spaced top surfaces of the floorings when the piece is installed. The body includes structure for interlocking with one of the floorings, which may include a tongue or groove when utilized with wood floorings comprising a plurality of slats interlocked by a tongue-and-groove arrangement. Moreover, the body presents a recessed surface configured to be spaced from and at least partly overlie the top surface of the other flooring so as to present a gap therebetween, when the transition piece is installed.

17 Claims, 2 Drawing Sheets

FLOOR TRANSITION PIECE AND METHOD OF INSTALLING SAME

BACKGROUND OF THE INVENTION

1. Field of the Invention

The present invention relates generally to a floor transition piece for spanning between first and second floorings having vertically offset top surfaces, such as a wood flooring and a vinyl flooring. More particularly, the present invention concerns a floor transition piece having a recessed surface that partly overlies the relatively lower flooring but is spaced thereabove so that the transition piece does not contact the second flooring. The present invention further concerns a transition piece including a removable protective sheet for temporarily covering a portion of the relatively lower flooring (e.g., during finishing of the upper flooring), and a method for installing the same.

2. Discussion of the Prior Art

A home or building often includes a variety of floorings such as vinyl, wood, linoleum, carpet, tile, etc. Because different floorings typically present relatively offset heights (i.e., the top surface of one flooring is spaced vertically from the top surface of another flooring), a transition piece must be installed at the juncture between adjacent floorings to present a surface extending generally between the vertically offset top surfaces of the floorings. Of course, it is desirable to provide an inexpensive transition piece that is simple to install, yet spans between adjacent floorings in an aesthetically pleasing manner.

However, conventional floor transition pieces present several problems. For example, transition pieces usually do not accommodate for relative expansion and contraction of the floorings. Particularly, floor transition pieces are often secured to both floorings such that relative shifting of the floorings may be restricted or cause damage to the transition piece. With respect to floorings adhesively attached to an underlying surface (e.g., vinyl or linoleum floorings), a number of conventional floor transition pieces rest against the edge of the flooring which often results in detachment of the flooring from the underlying surface (i.e., so-called "puckering" of the flooring), which will be described further hereinbelow. Wood flooring transition pieces are particularly problematic as it is often desirable to finish the transition piece along with the wood flooring. However, as will be further indicated below, finishing of traditional wood flooring transition pieces is difficult and often causes damage to the adjacent flooring.

OBJECTS AND SUMMARY OF THE INVENTION

Responsive to these and other problems, an important object of the present invention is to provide a floor transition piece for spanning between adjacent floorings presenting vertically offset top surfaces, wherein the transition piece has a simple, inexpensive and aesthetically pleasing construction. Another important object of the present invention is to provide a floor transition piece that accommodates for relative shifting between the adjacent floorings. It is also an object of the present invention to provide a floor transition piece that does not cause "puckering" of a flooring adhesively attached to an underlying surface. An additional important object of the present invention is to provide a floor transition piece particularly configured for use at the juncture between a wood flooring and a flooring adhesively attached to an underlying surface. Yet another important object of the present invention is to provide a floor transition piece for use with wood flooring, wherein the floor transition piece includes a removable protective sheet to partly overlie the adjacent flooring for providing a temporary covering, and a method for installing the same.

According to these and other objects apparent from the following description of the preferred embodiment, the present invention concerns a floor transition piece for spanning between first and second floorings, wherein the top surface of the first flooring is spaced vertically above the top surface of the second flooring. The transition piece comprises an elongated body having a transition surface for extending between the vertically spaced top surfaces of the floorings when the piece is installed. The body includes structure for interlocking with the first flooring, which may include a tongue or groove when utilized with wood floorings comprising a plurality of slats interlocked by a tongue-and-groove arrangement. Moreover, the body presents a recessed surface configured to be spaced from and at least partly overlie the top surface of the second flooring so as to present a gap therebetween, when the transition piece is installed.

In this respect, the transition piece does not contact the second flooring, which eliminates the risk of "puckering" when the piece is used with a flooring adhered to an underlying surface. The entire recessed surface is preferably configured to be spaced from the second flooring so as to accommodate relative shifting between the floorings.

A protective sheet may be removably attached to the recessed surface to project outwardly from the transition surface. Accordingly, the protective sheet may be removed immediately after the transition piece has been installed or, if desired, after finishing of the transition piece and/or first flooring. The sheet consequently serves to protect the underlying portion of the second flooring during finishing of the transition piece and/or first flooring. The present invention also concerns a method of installing a floor transition piece including a step of removably attaching such a protective sheet to the transition piece.

Other aspects and advantages of the present invention will be apparent from the following detailed description of the preferred embodiments and the accompanying drawing figures.

BRIEF DESCRIPTION OF THE DRAWING FIGURES

A preferred embodiment of the invention is described in detail below with reference to the attached drawing figures, wherein.

DETAILED DESCRIPTION OF THE PREFERRED EMBODIMENTS

Figures 1, 2, 4:
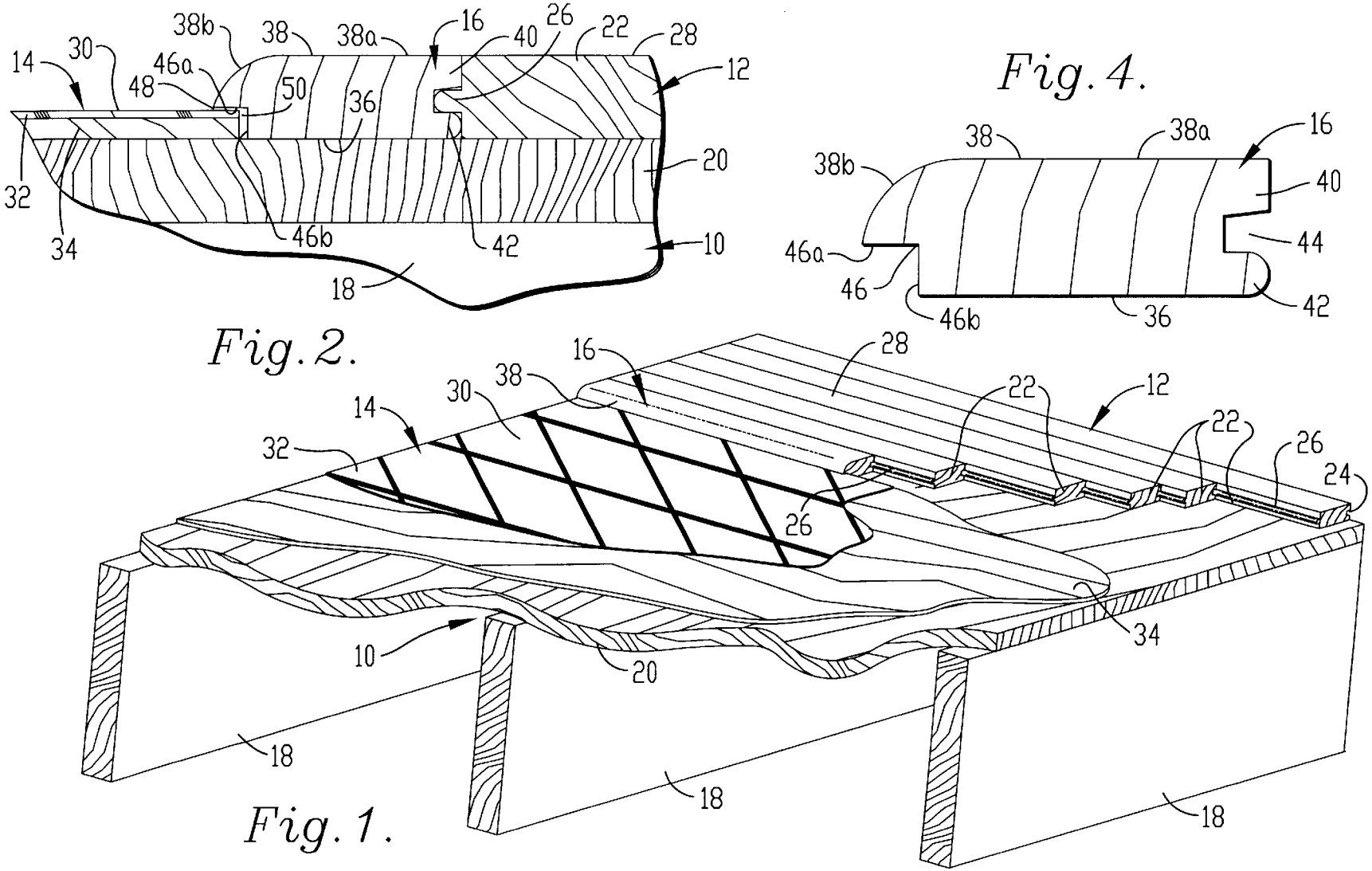
FIG. 1 is a fragmentary perspective view of a home or building construction including a floor transition piece constructed in accordance with the principles of the present invention.
FIG. 2 is an enlarged, fragmentary vertical cross-sectional view of the construction shown in FIG. 1, particularly illustrating the means for interlocking the transition piece with the first flooring, and the gap defined between the transition piece and the second flooring.
FIG. 4 is an enlarged, end elevational view of the floor transition piece.

As shown in FIG. 1, the home or building construction selected for illustration includes a subfloor 10 and spaced first and second floorings 12 and 14 supported on the subfloor 10. A floor transition piece 16, which is constructed in accordance with the principles of the present invention and which will be described in detail hereinbelow, is provided for spanning between the first and second floorings 12 and 14. As a matter of interest, the juncture between the first and second floorings 12 and 14 will often occur at a doorway between adjacent rooms of the home or building.

In the illustrated embodiment, the subfloor 10 comprises a plurality of laterally spaced floor joists 18 and a panel 20 supported on the upper ends of the joists 18. As those ordinarily skilled in the art will appreciate, each joist 18 is usually formed of a wood plank referred to as a "two-by-ten", while the panel 20 is commonly formed of three-quarter inch plywood. However, the principles of the present invention are equally applicable to various other subfloor constructions. For example, the inventive transition piece 16 may also be used on a subfloor comprising only the spaced floor joists or a subfloor formed of a material other than wood.

The first flooring 12 is a conventional wood flooring comprising a plurality of wood slats 22 supported on the top surface of the panel 20 and interlocked by a well known tongue-and-groove arrangement. Particularly, each slat 22 includes a longitudinally extending groove 24 defined along one side thereof and a longitudinally extending tongue 26 projecting laterally from an opposite side of the slat 22. When the flooring 12 is installed, the tongues and grooves of adjacent slats register with one another in a conventional manner to interlock the slats. Typically, the slats 22 are secured to the subfloor 10 by adhesives, such as glue, and/or mechanical fasteners, such as nails. The slats 22 cooperatively present a substantially flat and horizontal top surface 28 of the wood flooring 12.

The second flooring 14 has a top surface 30 that is spaced vertically below the top surface 28 of the wood flooring 12. In the illustrated embodiment, the second flooring 14 comprises a vinyl sheet 32 defining the top surface 30 and a suitable underlayment 34 for supporting the vinyl sheet 32 on the panel 20. In the usual manner, the vinyl sheet 32 is adhered to the underlayment 34, and the underlayment 34 is in turn fixed to the panel 20 by suitable means such as adhesive or mechanical fasteners.

Because the wood and vinyl floorings 12 and 14 are spaced from one another and their top surfaces 28 and 30 are vertically offset, it is important that the home or building construction be provided with structure for joining the floorings in an aesthetically pleasing, simple and inexpensive manner. Obviously, if structure is not provided to span between the floorings, the gap defined therebetween exposes the unsightly underlying subfloor 10 and presents potential risks for injury. In the past, adjacent floorings such as the wood and vinyl floorings illustrated herein have been joined several different ways.

Figures 3, 5, 6, 7, 8, 9:
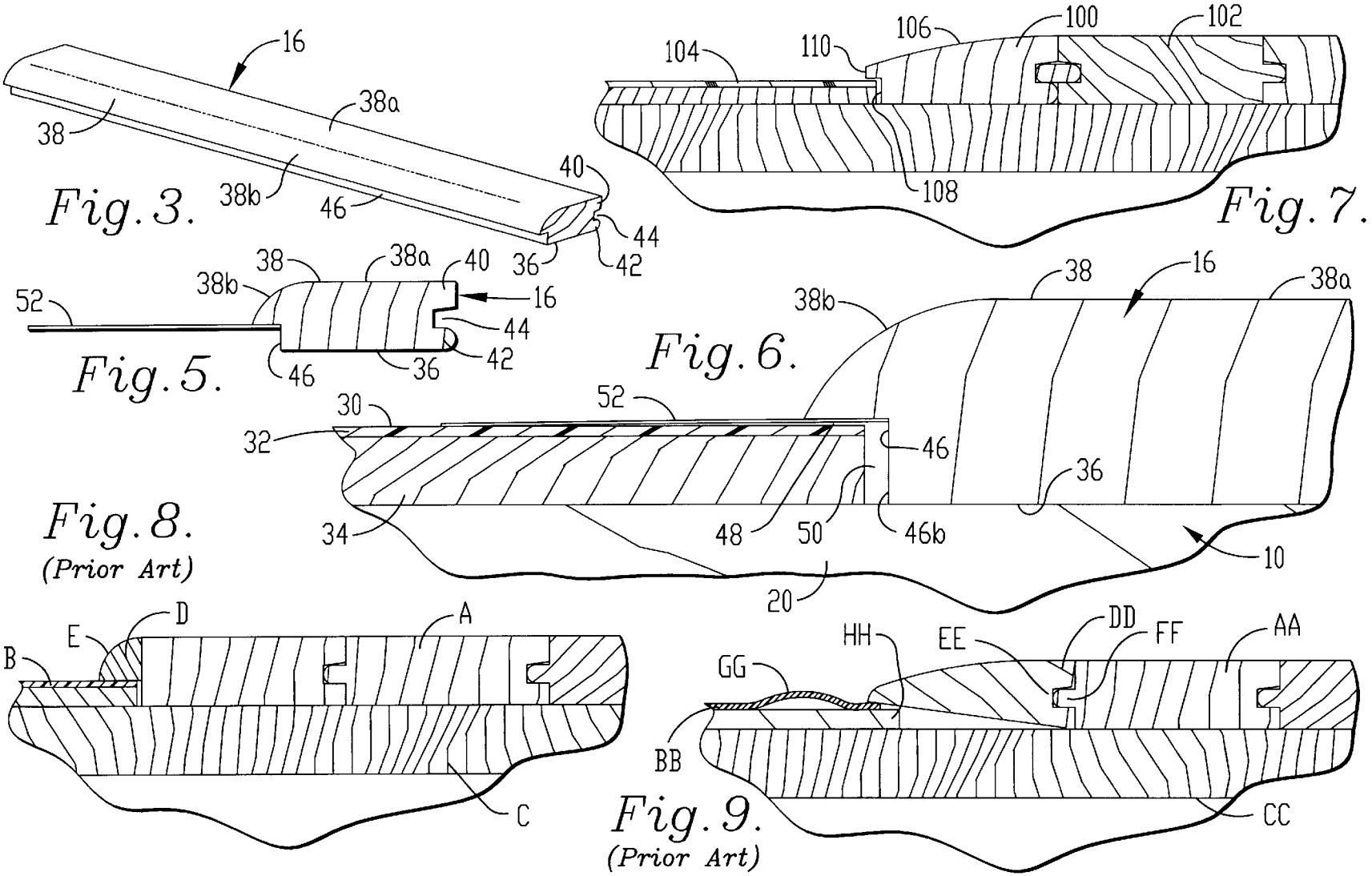
Fig. 8. (Prior Art)
Fig. 9. (Prior Art)
FIG. 3 is a perspective view of the floor transition piece.
FIG. 5 is an end elevational view of a transition piece provided with a removable protective sheet.
FIG. 6 is an enlarged, vertical cross-sectional view of the transition piece shown in FIG. 5, particularly illustrating the removable protective sheet in a covering relationship with respect to the second flooring.
FIG. 7 is a vertical cross-sectional view of a home or building construction including an alternative embodiment of the present invention.
FIG. 8 is a vertical cross-sectional view of a home or building construction including one conventional type of a floor transition piece.
FIG. 9 is a vertical cross-sectional view of a home or building construction including another conventional type of floor transition piece.

Turning to the prior art device shown in FIG. 8, a wood flooring A and vinyl flooring B have been installed on a subfloor C in a much closer condition than the floorings 12 and 14 show in FIGS. 1 and 2. In this instance, a semicircular-shaped transition piece D formed of so-called "base shoe" material is provided at the juncture between the wood and vinyl floorings A and B to cover the gap defined therebetween and to provide an arcuate transition surface E extending between the top surfaces of the floorings. The transition piece D is typically secured to both floorings A and B, which clearly presents a problem with respect to relative shifting of the floorings caused by, among other things, relative rates of thermal expansion and contraction. Further, the transition piece D is commonly formed of wood and is consequently finished along with the wood flooring A. Because the transition piece D rests directly against the top surface of the vinyl flooring B, a protective material cannot be placed therebetween such that sanding and/or coating of the transition piece D often damages the flooring B.

Another conventional method of joining adjacent floorings is shown in FIG. 9. In this depiction, the space defined between the wood flooring AA and the vinyl flooring BB is generally the same as that shown in FIGS. 1 and 2. Placed at the juncture between the floorings AA and BB is a conventional floor transition piece DD having a longitudinal groove EE for receiving the tongue FF projecting laterally from the wood flooring AA. It will be noted that the transition piece DD is canted relative to the floorings such that its bottom surface does not rest flatly against the subfloor CC. Instead, the transition piece DD has one edge of its bottom surface contacting the subfloor CC and the opposite edge of its bottom surface contacting the top surface of the vinyl flooring BB. Although not illustrated, it will be appreciated that when the transition piece DD is first installed the bottom surface thereof rests against the edge of the vinyl sheet GG. As those ordinarily skilled in the art will understand, such a conventional installation results in significant loads being exerted against the edge of the vinyl sheet GG which often causes detachment of the sheet GG from the underlayment HH. Such a phenomenon is often referred to as "puckering" of the vinyl sheet, as indicated above, and is clearly illustrated in FIG. 9. Similar to the conventional floor transition piece shown in FIG. 8, the transition piece DD is preferably formed of wood and therefore presents the same risk of damage to the vinyl sheet GG caused by finishing the piece DD and/or wood flooring AA.

FLOOR TRANSITION PIECE 16

Returning to FIGS. 1–6, the present invention addresses these and other concerns by providing a floor transition piece that overlies but does not contact the top surface 30 of the vinyl flooring 14. In the illustrated embodiment, the transition piece 16 comprises an elongated body presenting a generally flat bottom surface 36 and a generally opposite transition surface 38. As perhaps best shown in FIG. 2, the bottom surface 36 engages the panel 20 of the subfloor 10 to support the transition piece 16 thereon. The transition surface 38 is configured to extend generally between the top surfaces 28 and 30 of the wood and vinyl floorings 12 and 14, respectively, when the transition piece 16 is installed. Particularly, the transition surface 38 includes a generally flat portion 38*a*, which is coplanar with the top surface 28 of the wood flooring 12, and an arcuate portion 38*b*, which curves downwardly from the flat portion 38 to the top surface 30 of the vinyl flooring 14.

The transition piece 16 further includes structure defined along one side of the body for interlocking with the wood flooring 12. In the illustrated embodiment, this structure comprises a pair of longitudinally extending, spaced apart projections 40 and 42 defining a groove 44 therebetween for receiving the tongue 26 projecting laterally from the adjacent slat 22 of the wood flooring 12 (see FIG. 2). However, the interlocking structure may alternatively be constructed as a tongue (not shown) projecting laterally from the side of the transition piece 16, if the adjacent slat is provided with a groove rather than the illustrated tongue. Furthermore, the interlocking structure need not be limited to the same tongue-and-groove arrangement of the wood flooring 12; that is, it is entirely within the ambit of the present invention to provide the transition piece 16 with various other interlocking means. It will also be noted that the lower projection 42 is rounded, for purposes which will subsequently be described.

The elongated body forming the transition piece 16 further presents a recessed surface 46 having one section 46*a* projecting inwardly from the transition surface 38 and a relatively perpendicular section 46*b* projecting upwardly from the bottom surface 36. As perhaps best shown in FIG. 2, the recessed surface 46 defines a recess configured to receive the vinyl flooring 14 when the transition piece 16 is installed. Moreover, the horizontal section 46*a* of the recessed surface is configured to overlie a portion of the vinyl flooring 14 but is spaced from the top surface 30 of the flooring 14 so as to define a small gap 48 therebetween (see FIG. 2). It is also preferred that the vertical section 46*b* of the recessed surface 46 be spaced from the edge of the vinyl flooring 14 so as to define a space 50 therebetween. Because the transition piece 16 does not contact the vinyl flooring 14, relative shifting of the floorings 12 and 14 is not restricted, thereby avoiding the problems noted above with respect to the conventional installations. Furthermore, with the transition piece 16 being disengaged from the vinyl flooring 14, the phenomenon of "puckering" of the vinyl sheet 32 is avoided.

As shown in FIGS. 5 and 6, the transition piece 16 may be provided with a protective sheet 52 removably attached to the horizontal section 46*a* of the recessed surface 46 so that the sheet projects outwardly from the transition surface 38. Preferably, the protective sheet 52 is formed of a so-called "single-sided tape" having adhesive coated only on its upper side for releasibly adhering the sheet 52 to the transition piece 16. In this respect, when the transition piece 16 is installed, the protective sheet 52 overlies the portion of the vinyl flooring 14 adjacent the transition piece 16 so as to provide a temporary covering. This is particularly important when the transition piece 16 is formed of wood, and it is desired to finish the transition piece and/or wood flooring 12. In other words, the sheet 52 provides a temporary covering for protecting the vinyl sheet 32 from damage which may be caused during sanding and coating of the transition surface 38. Furthermore, because of the gap 48 defined between the top surface 30 of the vinyl flooring 14 and the horizontal section 46*a* of the recessed surface 46, the protective sheet 52 is not pinched therebetween and therefore may easily be removed after the transition piece 16 is installed (and after finishing of the transition piece 16, if desired).

In use, the wood and vinyl floorings 12 and 14 are installed to define a space therebetween for accommodating the transition piece 16. Prior to installing the transition piece 16, the protective sheet 52 may be removably attached to the horizontal section 46*a* of the recessed section 46. While the transition piece 16 is held at a slight angle relative to horizontal, the side of the transition piece having the interlocking means is slid along the panel 20 of the subfloor 10 toward the wood flooring 12 until the tongue 26 projecting from the flooring is received within the groove 44. It will be appreciated that the rounded outer edge of the lower projection 42 assists with guiding the projection 42 under the tongue 26 during such movement. Thereafter, the transition piece is dropped into place so that the bottom surface 36 rests flatly against the subfloor 10. Such interengagement between the subfloor 10 and the transition piece 16 provides a stable and durable installation. The transition piece 16 may be secured as it is slid into place by suitable adhesives, such as glue, or subsequent to such placement by mechanical fasteners, such as nails. With the sheet 52 providing a protective covering for the underlying portion of the vinyl sheet 32, subsequent finishing of the transition piece 16 and/or wood flooring 12 is unlikely to damage the vinyl sheet. It will be appreciated that the sheet 52 also protects the vinyl 32 from damage during installation of the transition piece 16. In this respect, removal of the protective sheet 52 may occur immediately after installation of the transition piece 16 or later once the wood flooring has been finished.

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention. For example, the transition piece 16 may be formed of various materials and utilized with various types of floorings.

Moreover, an alternative embodiment of the present invention is shown in FIG. 7, wherein a transition piece 100 is provided for spanning between similar wood and vinyl floorings 102 and 104. The transition piece 100 is generally similar to the transition piece 16 shown in FIGS. 1–6, except for the shape of the transition surface. Particularly, the transition piece 100 presents a transition surface 106 having an arcuate portion with a significantly larger radius than that shown in FIGS. 1–6. Further, the transition surface 106 and recessed surface 108 do not intersect, as with the previous embodiment, but rather a relatively short vertical surface 110 is defined therebetween.

The inventor hereby states his intent to rely on the Doctrine of Equivalents to determine and assess the reasonably fair scope of the present invention as pertains to any apparatus not materially departing from but outside the literal scope of the invention as set forth in the following claims.

What is claimed is:

1. A floor transition construction, comprising:

(a) a first flooring having a top surface, said first flooring supported by a subfloor and designed for accommodating foot traffic and other loads;

(b) a second flooring having a top surface, said second flooring supported by the subfloor and designed for accommodating foot traffic and other loads; said first flooring top surface spaced vertically above said second flooring top surface;

(c) a transition piece extending between said first flooring and said second flooring, said transition piece comprising:

(1) an elongated body, said body including a means for interlocking with said first flooring and presenting a longitudinally extending bottom surface configured to engage the subfloor for supporting the transition piece thereon; and (2) a longitudinally extending transition surface configured to extend between the vertically spaced top surfaces of the floorings, said body including means for interlocking with the first flooring; and (d) said body further having an arcuate portion curving downward from the top surface of the longitudinally extending transition piece configured to at least partly overlie the top surface of the second flooring and be spaced from the top surface of the second flooring so as to prevent contact between the body and the top surface of the second flooring when the transition piece is installed, and to withstand heavy forces to prevent the arcuate portion of the transition piece from breaking away from said body when heavy forces are applied to said arcuate portion.

2. A floor transition construction as claimed in claim 1, said transition surface including a substantially flat portion configured to be coplanar with the top surface of the first fooring, and an arcuate portion configured to curve from the flat portion toward the top surface of the second flooring when the transition piece is installed.

3. A floor transition construction as claimed in claim 1, and a protective sheet removably attached to the transition piece to project outwardly from the transition surface.

4. A floor transition construction as claimed in claim 1, said transition piece presenting relatively perpendicular sections, with one of the sections extending inwardly from the transition surface and being configured to overlie the top surface of the second flooring, and the other of the sections extending inwardly from the bottom surface.

5. A floor transition construction as claimed in claim 4, said other section of the transition piece being substantially perpendicular to the bottom surface.

6. A wood flooring transition construction, comprising:

(a) a wood flooring having a top surface; said wood flooring comprising a plurality of slats interlocked by a tongue-and-groove arrangement; said wood flooring supported by a subfloor and designed for accommodating foot traffic and other loads;

(b) a second flooring having a top surface, said second flooring supported by the subfloor and designed for accommodating foot traffic; said wood flooring top surface spaced vertically above said second flooring top surface;

(c) a wood flooring transition piece comprising an elongated body, said body including a means for interlocking with said wood flooring and presenting a longitudinally extending bottom surface and a longitudinally extending transition surface configured to extend between the vertically spaced top surfaces of the floorings, said body including means for interlocking with the wood flooring; said body including means for interlocking with the wood flooring; and (d) said body further having an arcuate portion curing downward from the top surface of the longitudinally extending transition piece, configured to at least partly overlie the top surface of the second flooring and be spaced from the top surface of the second flooring so as to prevent contact between the body and the top surface of the second flooring, when the transition piece is installed, and to withstand heavy forces to prevent the arcuate portion of the transition piece from breaking away from said body when heavy forces are applied to said arcuate portion.

7. A wood flooring transition construction as claimed in claim 6, said transition surface including a substantially flat portion configured to be coplanar with the top surface of the wood flooring, and an arcuate portion curving downwardly from the flat portion toward the top surface of the second flooring when the transition piece is installed.

8. A wood flooring transition piece as claimed in claim 6, said transition surface including a substantially flat portion configured to be coplanar with the top surface of the wood flooring, and an arcuate portion curving downwardly from the flat portion toward the top surface of the second flooring when the transition piece is installed.

9. A wood flooring transition construction as claimed in claim 6; and a protective sheet removably attached to the transition piece to project outwardly from the transition surface for providing a temporary covering for the second flooring.

10. A wood flooring transition construction as claimed in claim 6, said transition piece presenting relatively perpendicular sections, with one of the sections extending inwardly from the transition surface and being configured to overlie the top surface of the second flooring, and the other of the sections extending inwardly from the bottom surface.

11. A wood flooring transition construction as claimed in 10; and a protective sheet removably attached to said one section of the transition piece to project outwardly from the transition surface for providing a temporary covering for the second flooring.

12. A wood flooring transition construction as claimed in claim 10, said other section of the transition piece being substantially perpendicular to the bottom surface.

13. A method of installing a floor transition piece between the top surface of a first flooring and the spaced, relatively lower top surface of a second flooring, wherein a portion of the transition piece is configured to overlie and be spaced above the top surface of the second flooring, said method comnprising the steps of:

(a) removably attaching a protective sheet to said portion of the transition piece so that the protective sheet projects outwardly from the transition piece;

(b) placing the transition piece generally between the first and second floorings so that said portion of the transition piece overlies the top surface of the second flooring and the protective sheet covers a section of the second flooring adjacent the transition piece; and (c) removing the protective sheet from the transition piece after the piece has been placed between the floorings.

14. A method as claimed in claim 13; and (d) finishing the first flooring before the protective sheet is removed.

15. A method as claimed in claim 13, step (b) including the step of interlocking the transition piece with the first flooring.

16. A method as claimed in claim 15, step (b) including the step of securing the transition piece in place after it is interlocked with the first flooring.

17. A method as claimed in claim 16; and (d) finishing the first flooring before the protective sheet is removed.

* * * * *